US005509429A

United States Patent [19]

Brackmann

[11] Patent Number: 5,509,429

[45] Date of Patent: Apr. 23, 1996

[54] UNIFORM TAR DELIVERY PROFILE FILTER

[75] Inventor: Warren A. Brackmann, Mississauga, Canada

[73] Assignee: Kothmans, Benson & Hedges Inc., North York, Canada

[21] Appl. No.: 370,570

[22] Filed: Jan. 9, 1995

Related U.S. Application Data

[63] Continuation of Ser. No. 275,324, Jul. 14, 1994, abandoned, which is a continuation of Ser. No. 76,843, Jun. 15, 1993, abandoned, which is a continuation of Ser. No. 752,595, Oct. 31, 1991, abandoned.

[30] Foreign Application Priority Data

| | | | |
|---|---|---|---|
| Mar. 2, 1989 | [GB] | United Kingdom | 8904752 |
| Apr. 27, 1989 | [GB] | United Kingdom | 8909660 |

[51] Int. Cl.[6] ..... A24D 3/04

[52] U.S. Cl. ..... 131/339; 131/341

[58] Field of Search ..... 131/331, 339, 131/340, 341, 344

[56] References Cited

U.S. PATENT DOCUMENTS

| | | | |
|---|---|---|---|
| 2,763,267 | 9/1956 | Muller | 131/208 |
| 3,648,712 | 3/1972 | Patterson | 131/10.5 |
| 3,809,097 | 5/1974 | Clayton et al. | 131/10.7 |
| 3,882,877 | 5/1975 | Brackmann | 131/266 |
| 4,022,222 | 5/1977 | Berger | 131/344 X |
| 4,460,000 | 7/1984 | Steinberg | 131/296 |
| 4,469,112 | 9/1984 | Browne et al. | 131/336 |
| 4,747,418 | 5/1988 | Veluz | 131/331 |
| 4,896,682 | 1/1990 | Liew | 131/339 |
| 4,972,853 | 11/1990 | Brackmann et al. | 131/339 |
| 5,190,061 | 3/1993 | Brackmann et al. | 131/331 X |

FOREIGN PATENT DOCUMENTS

| | | |
|---|---|---|
| 1339238 | 10/1973 | United Kingdom . |
| 2102271 | 2/1983 | United Kingdom . |
| 2103065 | 2/1983 | United Kingdom . |
| 2105566 | 3/1983 | United Kingdom . |

*Primary Examiner*—Jennifer Bahr
*Attorney, Agent, or Firm*—Sim & McBurney

[57] ABSTRACT

A tobacco smoke filter element (14) produces a more uniform tar delivery profile without an unacceptable pressure drop by causing the cigarette smoke to assume a progressively longer flow path through an outer cylinder (20) of higher flow resistance filter tow material before passing radially inwardly through a cylinder (24) of microfine fibres into a low resistance flow path (26) to the smoker's mouth. The progressively increased flow path results from progressive clogging of the cylinder of microfine fibres by filtered material as smoking of the cigarette progresses.

6 Claims, 1 Drawing Sheet

UNIFORM TAR DELIVERY PROFILE FILTER

This is a continuation of application Ser. No. 08/275,324 filed Jul. 14, 1994, now abandoned, which is a continuation of application Ser. No. 076,843, filed Jun. 15, 1993, now abandoned, which is a continuation of application Ser. No. 752,595 filed Oct. 31, 1991, now abandoned.

TECHNICAL FIELD

The present invention relates to a novel cigarette smoke filter element which is able to provide a more uniform tar delivery profile to the smoker than has heretofore been possible, and to cigarettes incorporating such filter elements.

BACKGROUND ART

It is well known that when either a smoker or a smoking machine smokes a conventional filter-tipped cigarette, the amount of "tar" in each puff increases in each successive puff. The "tar" yield of the last few puffs is usually several times higher than that from the first few puffs. Consequently the "tar" in the last few puffs may be perceived by a smoker as "too strong", and a smoker, therefore, may consider a cigarette as "smoother", if the "tar" delivery profile can be made more even.

There have been many attempts in the past to achieve an "even" puff cigarette by modifying the filter. Mullor, U.S. Pat. No. 2,763,267 and Clayton et al, U.S. Pat. No. 3,809,097 proposed to use a plurality of discs to be placed inside a cigarette filter rod and placed transverse to the smoke flow. These designs, however, can only improve filtration efficiency, but without any ability of evening the cigarette "tar" profile.

Patterson, U.S. Pat. No. 3,648,712 proposed to use a low gas permeability disc placed transversely inside an ordinary cellulose acetate filter rod. The disc is of a diameter which is 5 to 25 percent less than the diameter of the filter rod and this filter, therefore, can only achieve improved filtration efficiency, with no ability to even the "tar" delivery profile.

B.A.T. GB Pat. No. 1,339,238 proposed placing a disc of a blocking plug between a tobacco rod and an ordinary cellulose acetate filter rod. This disc has an orifice for smoke to flow through. The disadvantage of this design is that the pressure drop of the cigarette increases to an unacceptable level as the orifice of the plug becomes clogged up at the later puffs.

Brackmann et al,. U.S. Pat. No. 3,882,877 proposed placing a disc of microfine fibres in between two filter rod segments. This filter is designed to increase filtration efficiency. However, it could not cause the "tar" delivery to be more even, furthermore the pressure drop may increase to an unacceptable level at the later puffs.

Browne et al., U.S. Pat. Nos. 4,460,000 and 4,469,112 proposed using a compound filter that contains a perforated barrier disc through which the whole smoke passes to a cellulose acetate filter rod segment. As the smoking process proceeds, more and more "tar" builds up on the cellulose acetate fibres around the exit of the perforations. The disadvantage of this design is that the build-up of "tar" near the perforations will greatly increase the flow resistance of the cigarette filter to an unacceptable level.

G.B. Pat. Nos. 2,102,271 A, 2,103,065 A, and 2,105,566 A of Filtrona (U.K.), proposed to employ two flow paths, i.e. a low pressure drop path which has low filtration efficiency and a high pressure drop path which has high filtration efficiency, for the smoke to flow in a filter rod. During the initial few puffs of a cigarette, it is intended that the smoke flow through the low pressure drop path. The smoke then switches to flow through the high pressure drop path due to the presence of a blocking mechanism on the low pressure drop path. The disadvantage of these filters is that they are very complicated and difficult to manufacture.

U.S. Pat. No. 4,747,418 uses a filter element in the form of a membrane having a large number of tiny openings in combination with openings downstream of the membrane through which air may be drawn or conventional filter substance in an attempt to produce a more uniform tar delivery. Again a complicated and expensive structure is required.

DISCLOSURE OF INVENTION

In accordance with the present invention, an improved filter structure is provided wherein two different filter materials are combined to achieve a more uniform tar delivery.

Accordingly, in one aspect of the present invention, there is provided a cigarette smoke filter element, characterized by an outer elongate cylinder of tobacco smoke filter material, an inner elongate cylinder of microfine fibres and an axial cigarette smoke path radially inwardly of the cylinder of microfine fibres. The outer cylinder of smoke filter material has a greater resistance to the flow of cigarette smoke therethrough .than the axial flow path.

Tobacco smoke flow path directing means is located at one end of the filter element for directing cigarette smoke from a cigarette to which the filter element is attached, only into the outer cylinder of tobacco smoke filter material. In this way, cigarette smoke directed from a cigarette into the outer cylinder passes first through the outer cylinder, and then through the inner cylinder into the axial low resistance flow path.

As smoking of the cigarette proceeds, the tobacco smoke is forced to flow by a progressively-increasing length of flow path through the outer cylinder as a progressively greater proportion of the length of the inner cylinder becomes clogged with tar filtered from the tobacco smoke. As explained in more detail below, this effect leads to a more uniform delivery of tar in the cigarette smoke to the smoker's mouth.

The cylinder of microfine fibres may be provided between two outer porous support layers. The microfine fibres may be formed as described in the aforementioned U.S. Pat. No. 3,882,877, the disclosure of which is incorporated herein by reference. The microfine fibres in the cylindrical layer thereof may have any convenient diameter to achieve the desired filtration as described herein, generally from about 0.5 to about 10 microns. The cylindrical layer may have any convenient thickness to achieve the desired filtration as described herein, generally from about 0.05 to about 4 mm. The microfine fibres may be packed to any desired degree to achieve the desired filtration, generally from about 0.05 to about 0.3 g/cc.

The outer annulus of filter material may comprise any of the well-known filtration materials commonly employed in cigarette filters, generally cellulose acetate tow with its fibres extending predominantly axially along its length, or a non-woven fibrous material, such as DANAKLON ES (polypropylene/polyethylene bicomponent fibres made by Danaklon, Denmark).

The microfine fibres are a highly efficient cigarette smoke filtration medium and function to remove liquid components from the smoke, as described more fully in U.S. Pat. No. 3,882,877. The filtration is so efficient that the filter can rapidly become blocked and permits no further smoke filtration to occur.

The latter effect is employed to advantage in the novel cigarette smoke filter of the invention, where the cigarette smoke is drawn in the same axial direction as the direction of extension of the cigarette filter components. As the first few puffs are taken, smoke enters the annulus material and then passes through the microfine fibres into the low resistance smoke flow passage to the smoker's mouth. The microfine fibres in the area where the smoke is drawn through rapidly become clogged, so that the smoke is forced to assume a longer path of travel through the annulus material until it can pass through the microfine fibres into the low resistance smoke path.

As the cigarette is smoked, it is necessary for the cigarette smoke to travel for progressively greater distances in the annulus material before it can pass through the microfine fibres. A uniform amount of droplet material is removed from the smoke by the microfine fibres along the whole of the length of the filter, since each successive portion of the fibres is able to filter out only the same maximum quantity of droplets. However, by forcing the smoke to assume a progressively longer path of travel through the annulus filter material progressively greater quantities of droplets are removed from the smoke aerosol. The result of this filtration operation is that the smoke entering the smoker's mouth has a substantially uniform tar content and the problem of increasing tar yield from the cigarette is compensated for by providing progressively increased filtration of the tobacco smoke before it reaches the smoker's mouth, without introducing an unacceptable level of pressure drop.

Accordingly, in another aspect of the present invention, there is provided a method of achieving a more uniform delivery of tar in tobacco smoke entering a smoker's mouth from a cigarette, characterized by causing the tobacco smoke to pass from a burning cigarette first into an outer cylinder of tobacco smoke filter material of higher resistance to smoke flow, and then through an inner cylinder of microfine fibres into an axial flow path to the smoker's mouth of lower resistance to smoke flow, filtering filterable materials, including tar, from the smoke both in the outer cylinder and the inner cylinder, and causing said smoke to pass through a progressively longer flow path through said outer cylinder as a progressively increased proportion of the inner cylinder becomes incapable of effecting filtration, thereby to remove progressively greater proportion of filterable materials, including tar, from the tobacco smoke.

BEST MODE FOR CARRYING OUT INVENTION

Figure 1:
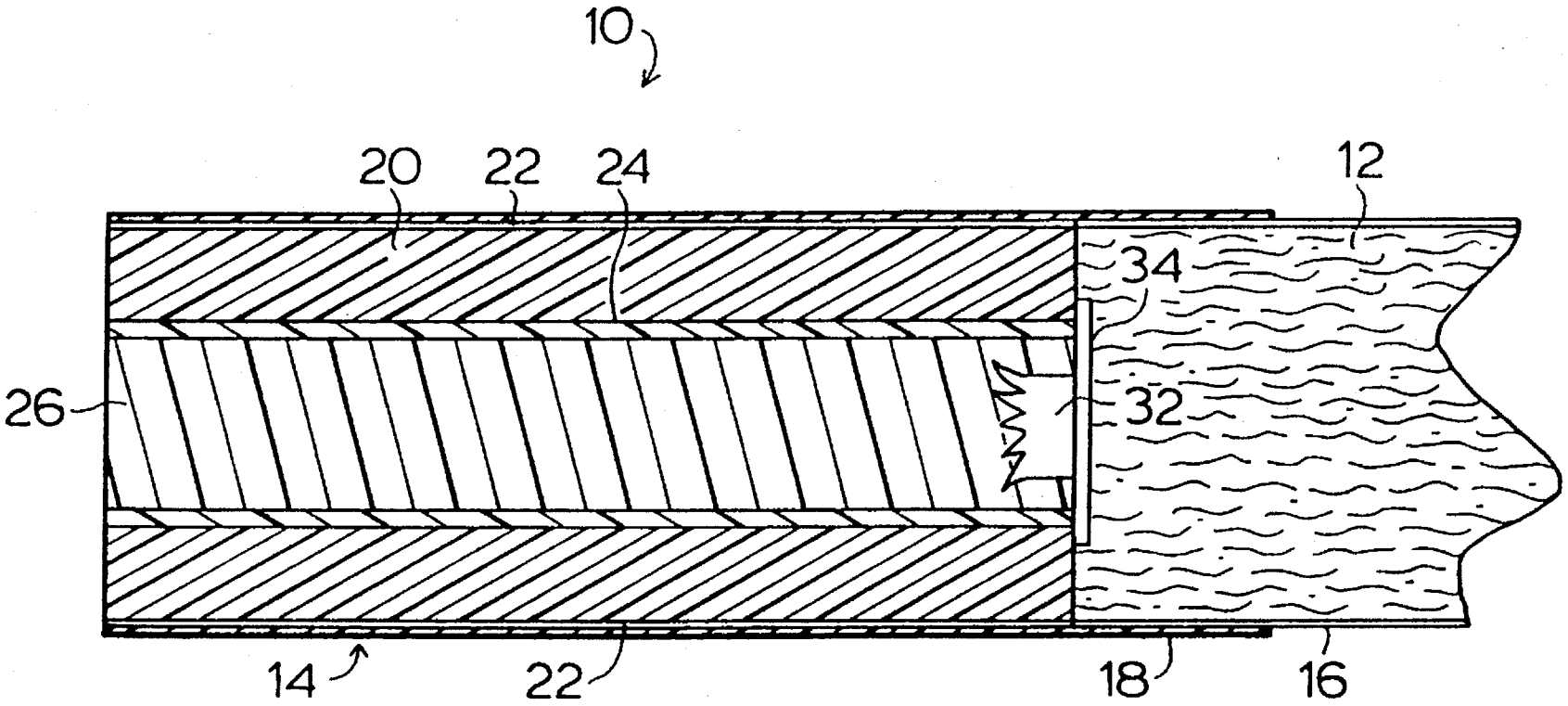
FIG. 1 is a schematic sectional view of a novel cigarette filter constructed in accordance with one embodiment of the invention.

Referring to the drawing, a cylindrical cigarette 10 includes a cigarette rod 12 and a novel filter 14, having a construction which the applicants regard as the current best mode of carrying out the invention. The cigarette rod 12 has a conventional paper wrapper 16 and is joined to the filter 14 by a conventional cork wrap 18.

The filter 14 comprises an outer annulus 20 of conventional cellulose acetate tow material having an outer wrap 22. A cylinder of microfine fibres 24 abuts the inner radial extremity of the annulus 20 and typically is supported between outer layers of low flow resistance fabric.

The cylinder 24 is sandwiched between the annulus 20 and an inner plug 26 of low flow resistance material, such as low flow resistance acetate. The inner plug 26 may be omitted entirely, if desired, but preferably is employed to provide mechanical strength and stability to the structure. Alternative support structures may be employed, such as an extruded plastic core with a star-shaped cross-section or other convenient shape providing smoke flow channels radially inwardly of the cylinder. 24.

At the end of the filter 14 opposite to the smoking end of the cigarette 10, the filter is sealed against the flow of cigarette smoke directly from the cigarette rod 16 to the acetate plug 26, such as by crimping 32 the acetate plug 26, and/or by providing a circular baffle 34 overlying the end of the acetate plug 26.

The provision of such flow directing means ensures that any smoke drawn by the smoker from the cigarette rod 12 enters the outer annulus 20 of acetate tow. Since the inner plug 26 provides a lower resistance flow path for the cigarette smoke than the higher flow resistance annulus, the cigarette smoke tends to want to flow radially inwardly from the resistance annulus 20 into the acetate plug 26, which results in the smoke passing through the cylinder of fibrous filter material 24.

The smoke follows the path of least resistance so that, initially; the smoke flows only for a short distance through the annulus material 20 before flowing through the microfine fibres into the acetate plug 26. However, the microfine fibres effect efficient filtration of the tobacco smoke to remove smoke-borne particulates including tar-containing droplets and the fibres eventually are unable to effect further filtration. Accordingly, the microfine fibres in the cylinder 24 become, in the direction towards the smoking end of the cigarette 10, progressively unable to effect filtration.

The cigarette smoke, therefore, is required to transverse a progressively longer path through the annulus filtration material 20 before the smoke can travel radially inwardly into the acetate plug 26. In this way, a progressively greater degree of filtration is effected by the annulus material 20 and, thereby, a progressively greater degree of overall filtration is effected as the cigarette 10 is smoked, thereby compensating for the progressively greater tar production by the cigarette rod 12.

In the illustrated embodiment, smoke can pass from the annulus material 20 directly into the smoker's mouth. However, the predominant smoke flow path is via the acetate plug 26 because of its lower resistance to smoke flow. In addition, if desired, an annular barrier may be provided overlying the smoking end of the annulus material 20 to force all the smoke to flow to the smoker's mouth through the acetate plug 26.

The filter element 10 may be formed in any convenient manner. In one embodiment, the acetate plug 26 is replaced by an extruded plastic core having a star-shaped cross section so as to provide a plurality of channels through which the filtered smoke can pass to the smoker. The plastic core then is reciprocated in front of a fine fibre extruder on a continuous basis. The plastic core is rotated about its axis, so that the fibers are collected in an uniform layer 24 on the periphery of the core i.e., at the radial extremities of the points of the star. The relatively few microfine fibers which may randomly extend into the air passages between the points of the star-shaped cross section are not sufficient to affect significantly the low pressure drop ducts between the legs of the star.

The continuous rod then is passed through a filter-making machine, wherein the core is periodically crimped and the normal high efficiency filter material 20 is placed on the outside of the layer 24 of microfine fibres. The filter then is wrapped in conventional plug wrap 22 and cut at the crimped points to provide a plurality of filter elements 14.

INDUSTRIAL APPLICABILITY

The present invention provides a novel cigarette filter structure to provide a uniform delivery of tar to a smoker by providing for successively greater degrees of filtration as the cigarette is smoked, without producing unacceptable levels of pressure drop. Cigarettes are a staple item of commerce. Modifications are possible within the scope of this invention.

What we claim is:

1. A cigarette smoke filter element, comprising:

an outer elongate annular cylinder of tobacco smoke filter materials having a higher resistance to cigarette smoke flow therethrough, an inner elongate hollow cylinder of microfine fibres which is supported as said cylinder by radially-inwardly located support means, microfine fibres in said cylinder thereof each having a diameter from about 0.5 to about 10 microns, said cylinder of microfine fibres having a thickness of about 0.05 to about 4 mm and a density of about 0.05 to about 0.3 g/cc, said cylinder of microfine fibres having a tendency to become clogged against further cigarette smoke passage therethrough by tar filtered from cigarette smoke passing therethrough, an axial cigarette smoke path radially inwardly of said hollow cylinder of microfine fibres having a lower resistance to cigarette smoke flow therethrough than said outer annular cylinder of smoke filter material, and tobacco smoke flow path directing means located at one end of said filter element for directing cigarette smoke from a cigarette to which the filter element is attached, only into said outer annular cylinder of cigarette smoke filter material, whereby cigarette smoke from the cigarette passes to the smoker along a cigarette smoke flow path of fixed length and cigarette smoke from the cigarette during smoking of the cigarette is caused to pass through a progressively longer flow path through said outer cylinder before passing through said inner cylinder into said axial cigarette smoke path as a progressively increased proportion of said inner cylinder becomes incapable of effecting filtration as a result of said clogging, thereby removing a progressively greater proportion of filterable materials, including tar, from the cigarette smoke as the cigarette is smoked.

2. The filter element of claim 1, characterized in that the outer cylinder of tobacco smoke filter material is conventional cellulose acetate tow filter material.

3. The filter element of claim 2, characterized in that said deflection means is provided by baffle means at said one end of said filter element.

4. A filter element as claimed in claim 1, 2 or 3 in combination with a cigarette rod in a cigarette, with said tobacco smoke flow path directing means being located adjacent the join of said filter element to said cigarette rod.

5. A method of achieving a more uniform delivery of tar in tobacco smoke entering a smoker's mouth from a cigarette, which comprises:

causing said tobacco smoke to pass from a burning cigarette first into an outer cylinder of tobacco smoke filter material of higher resistance to smoke flow, then through an inner b cylinder of microfine fibres which is supported as said cylinder from radially inwardly and has a wall thickness of about 0.05 to about 4 mm, a density of about 0.05 to about 0.3 g/cc and in which each fibre has a diameter of from about 0.05 to about 10 microns and into an axial flow path to the smoker's mouth of lower resistance to smoke flow than said outer cylinder of tobacco smoke filter material thereby establishing a cigarette-smoke flow path of fixed length from the cigarette to the smoker's mouth, filtering filterable materials, including tar, from said smoke both in said outer cylinder and said inner cylinder, said inner cylinder having a tendency to become clogged against further tobacco smoke passage therethrough by filterable materials, including tar, filtered from tobacco smoke passing therethrough, and causing said tobacco smoke to pass through a progressively longer flow path through said outer cylinder as a progressively increased proportion of said supported inner cylinder becomes incapable of effecting filtration as a result of clogging by filtered materials, thereby removing a progressively greater proportion of filterable materials, including tar, from the tobacco smoke as smoking of the burning cigarette progresses.

6. The method of claim 5 wherein said inner cylinder of microfine fibres is supported by an inner plug of low flow resistance acetate material.

* * * * *

UNITED STATES PATENT AND TRADEMARK OFFICE

CERTIFICATE OF CORRECTION

PATENT NO. : 5,509,429

DATED : Apr. 23, 1996

INVENTOR(S) : Warren A. Brackmann

It is certified that error appears in the above-identified patent and that said Letters Patent is hereby corrected as shown below:

On title page, item [73], "Kothmans" should read --Rothmans--

Signed and Sealed this

Twenty-ninth Day of October 1996

*Attest:*

Bruce Lehman

BRUCE LEHMAN

*Attesting Officer*

*Commissioner of Patents and Trademarks*